US005613761A

United States Patent [19]

Raby, Sr. et al.

[11] Patent Number: 5,613,761

[45] Date of Patent: Mar. 25, 1997

[54] MATERIAL AND METHOD FOR FABRICATING A LIGHT FIXTURE REFLECTOR, AND, REFLECTOR PRODUCED THEREBY

[76] Inventors: Frederick R. Raby, Sr.; Bruce R. Raby, both of 3030 North Middle Side Road, Amherstburg, Ontario, Canada, N9V 2Y9

[21] Appl. No.: 501,671

[22] Filed: Jul. 12, 1995

Related U.S. Application Data

[63] Continuation-in-part of Ser. No. 310,254, Sep. 21, 1994, abandoned.

[51] Int. Cl.[6] ..... F21S 3/00

[52] U.S. Cl. ..... 362/217; 362/260; 362/347; 359/846; 359/852; 428/182

[58] Field of Search ..... 362/341, 347, 362/260, 217, 297; 428/34, 182; 126/684, 696; 359/846, 848, 852

[56] References Cited

U.S. PATENT DOCUMENTS

| | | | |
|---|---|---|---|
| 4,024,852 | 5/1977 | L'Esperance et al. . | |
| 4,343,533 | 8/1982 | Currin et al. . | |
| 4,435,043 | 3/1984 | Mertens et al. . | |
| 4,514,793 | 4/1985 | Andreasen | 362/347 |
| 4,599,684 | 7/1986 | Lee | 362/217 |
| 4,669,033 | 5/1987 | Lee | 362/217 |
| 4,719,546 | 1/1988 | Spitz | 362/260 |
| 4,814,954 | 3/1989 | Spitz | 362/260 |
| 4,842,398 | 6/1989 | Ducassou | 359/846 |
| 4,855,883 | 8/1989 | Spitz | 362/260 |
| 4,928,209 | 5/1990 | Rodin | 362/217 |
| 5,062,030 | 10/1991 | Figueroa | 362/260 |
| 5,132,885 | 7/1992 | Hocheim et al. . | |
| 5,142,459 | 8/1992 | Swarens et al. | 362/347 |

FOREIGN PATENT DOCUMENTS

| | | | |
|---|---|---|---|
| 267806 | 11/1990 | Japan | 362/347 |

*Primary Examiner*—Ira S. Lazarus
*Assistant Examiner*—Sara Sachie Raab
*Attorney, Agent, or Firm*—John R. Benefiel

[57] ABSTRACT

A lightweight reflector is fabricated from corrugated plastic sheet by bonding a mirrored film on a cover layer having a great number of closely spaced lengthwise depressions so that a corresponding series of striations form a reflector surface having a multitude of facets, the sheet to be formed into a concavely curved shape which shape may be held with a wire secured crosswise to the sheet at a point intermediate the ends. In the preferred embodiment, single faced corrugated plastic sheeting is used which can readily be shaped in a curved shape.

20 Claims, 4 Drawing Sheets

MATERIAL AND METHOD FOR FABRICATING A LIGHT FIXTURE REFLECTOR, AND, REFLECTOR PRODUCED THEREBY

CROSS-REFERENCE TO RELATED APPLICATION

This application is a continuation-in-part of application Ser. No. 08/310,254, filed Sep. 21, 1994, now abandoned.

BACKGROUND OF THE INVENTION

This invention concerns reflectors, particularly reflectors to be installed in fluorescent light fixtures. Recent trends to save energy have resulted in the reconfiguration in the field of fluorescent light fixtures to have reduced numbers of tubes, i.e., four tube fixtures have been converted to two tube fixtures, and two tube fixtures converted to one tube fixtures.

In such reconfiguration, a reflector is often added to increase the light output of the fixture and to eliminate shadows sometimes occurring at the original tube locations when the tubes are relocated.

See U.S. Pat. No. 4,514,793 issued on Apr. 30, 1985, for a "Reflector System for Securing to a Light Source" for an example of such a reflector installation.

See also U.S. Pat. No. 4,719,546 issued on Jan. 12, 1988; U.S. Pat. No. 4,814,954 issued on Mar. 21, 1989; and, U.S. Pat. No. 4,855,883 issued on Aug. 8, 1989; and, U.S. Pat. No. 5,062,030 issued on Oct. 29, 1991, all concerning reflectors for fluorescent light tube fixtures.

U.S. Pat. No. 5,142,459, issued on Aug. 25, 1992, describes a reflector which is snap-fit into the fixture housing.

See also U.S. Pat. No. 4,928,209 issued on May 22, 1990 for a "Lighting Apparatus" for an example of a reflector added to a retrofit light fixture.

For field installations, the reflectors must be custom fit to the particular configuration of the fixture housing. In addition, the reflector must be mounted in some manner within the fixture housing. The prior reflectors, have, for the most part, consisted of formed metal pieces which are relatively heavy and which must be securely anchored within the fixture housing. In addition, the cutting and forming of the metal reflector piece is time consuming and difficult.

U.S. Pat. No. 4,599,684 issued on Jul. 8, 1986 for a "Light Reflector System" and U.S. Pat. No. 4,669,033 issued on May 26, 1987 for an "Adjustable Optical Reflector for Fluorescent Fixture" both describe lightweight reflectors suitable for retrofitting existing fixtures.

As mentioned above, the reflectors should preferably eliminate the presence of shadow lines in order for a uniform appearance of the light transmitting panel enclosure covering the fixture tubes. Such need has required a special shape of the prior reflector configurations.

In U.S. Pat. No. 4,669,033 mentioned above, the reflector is formed with score lines, creating a multifaceted reflector for this purpose. The need for scoring the material adds to the manufacturing cost, and the limited number of facets does not entirely disperse the light pattern.

U.S. Pat. No. 4,343,533 issued on Aug. 10, 1982 for a "Solar Radiation Reflector with a Cellulosic Substrate and Method of Making" describes the manufacture of a reflector using corrugated cardboard as the backing material. The use of cardboard renders the reflector unsuitable for use in light fixtures.

U.S. Pat. No. 4,024,852 issued on May 24, 1977 for a "Solar Energy Reflector Collector" describes the use of a reflectorized corrugated plastic for use as a solar collector. In that design, the reflecting surface is made as smooth as possible in order to focus solar radiation for heat collection using a parabolic shape, and thus is not suitable for dispersal of light in a fixture.

Retrofitting of existing fixtures with reflectors also requires a means for properly supporting the reflectors in the housing. The relatively heavy reflectors heretofore proposed needed complicated support arrangements and separate fasteners.

Accordingly, it is an object of the present invention to provide a material and method for fabricating a reflector for florescent light tube fixtures which is readily adapted to custom fit field installations and which provides a dispersal of the reflected light such as to minimize the presence of any shadowed areas when the fixture is viewed from below.

It is a further object to provide a reflector material which is light in weight such as to be easily mounted within the light fixture housing without the need for special clips or threaded fasteners and the like, and which can be easily cut and formed in being custom fit in the field to a fluorescent light fixture.

It is a further object to provide a simplified arrangement for installing a reflector in a light fixture housing.

SUMMARY OF THE INVENTION

The present invention comprises a reflector used in a light fixture comprised of a corrugated plastic sheet having one surface treated to be brightly reflective by adhesively bonding a very thin metallized, mirrored film to one face of the corrugated plastic sheet. The thin reflective film when applied to one surface of the corrugated plastic conforms closely to lengthwise surface valleys on the corrugated plastic to create a great number of lengthwise striations in the reflector surface. The striations in turn create a reflector having a multitude of facets which improve the dispersal of the reflected light while maintaining a high degree of reflectivity to insure a more uniform light pattern. The formation of these facets does not require a separate scoring operation.

The corrugated plastic is preferably single faced such that the sheet is readily formed into a curved shape, and so that the striations are enhanced when the sheet is formed into a curved, trough shape by slight bending occurring along the striations.

The corrugated plastic is preferably single faced to facilitate the formation into the curved shape, with the single face disposed on the concave surface having the mirrored film adhered thereto. The exposed corrugations on the opposite side are free to separate, facilitating the shaping into the curved shape. A single, centrally located, yieldably bendable wire passed crosswise through the corrugations is used to hold the curved shape once formed. A single wire element speeds the task and avoids asymmetrical shaping of the ends of the reflector.

Double faced corrugated plastic can be used, but in this case, the outer layer on the opposite side of the corrugated plastic sheet is slit lengthwise through the topmost layer at short intervals along the width of the sheet. The slitting enables the ready formability of the corrugated plastic into the concavely curved trough shape with the concavity thereof being the surface having the film attached such as to form the trough shaped reflector.

The lightweight nature of the plastic sheet enables it to be easily force fit within the fixture housing. The corrugated sheet material is also easily trimmed with ordinary scissors such as to allow easy, custom fitting of the reflector to fluorescent light fixtures in field applications.

The concavely curved shape may also be maintained by means of pairs of bendable wire lengths which are attached at either end of the curved sheet such that when the wire lengths are bent into a particular curved shape they hold the corrugated plastic sheet piece in that shape.

End pieces may also be fit to the reflector sheet to establish the concave shape. These end pieces may also be slotted in such a way as to receive the light tube to hold the reflector in the light fixture housing spaced above the tube.

As another alternative, folded support pieces have a pair of openings sized to be tightly received over the light tube, which can be squeezed together to arch upwardly against the inside of the reflector, which is thereby held in the housing spaced above the tube.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and indeed should not be so construed inasmuch as the invention is capable of taking many forms and variations within the scope of the appended claims.

Figure 1:
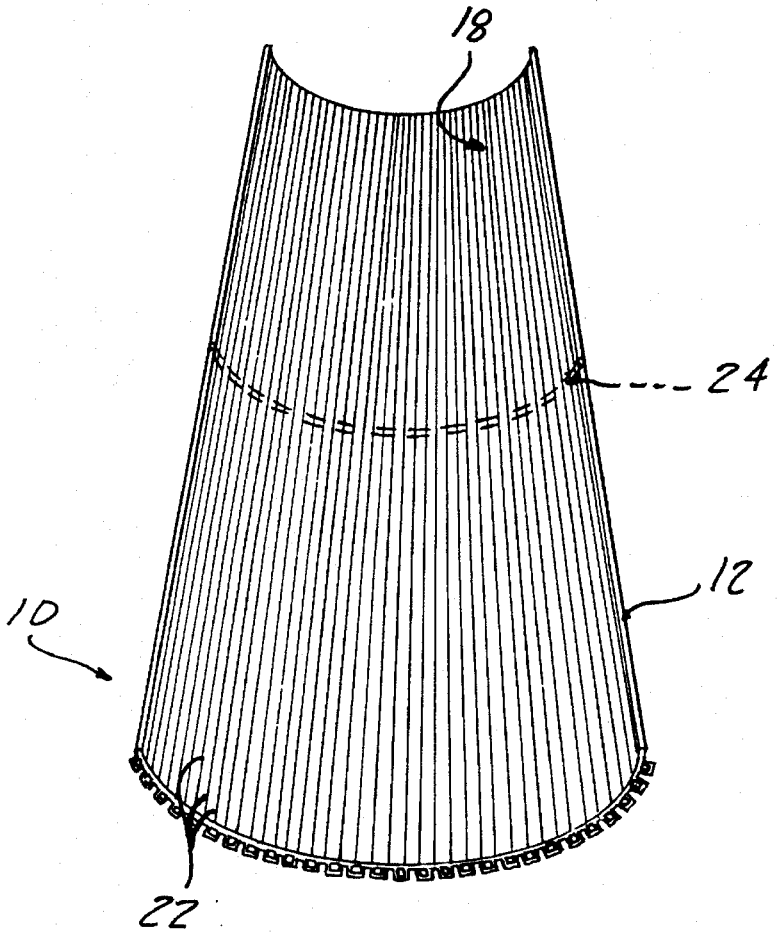
FIG. 1 is a fragmentary perspective view of a sheet of single faced corrugated plastic material having a thin metallized film bonded to an outer layer to create a multitude of lengthwise striations, the sheet formed into a concave shape to create a lightweight reflector for use with a fluorescent tube light fixture.
Figure 2:
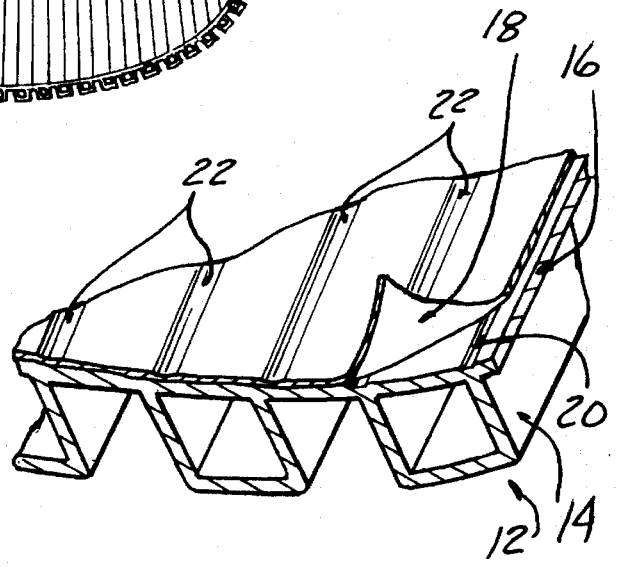
FIG. 2 is a fragmentary enlarged end view of a portion of the reflector shown in FIG. 1.
Figure 3:
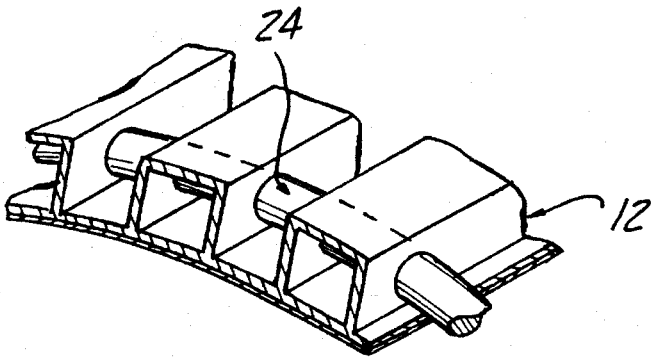
FIG. 3 is a fragmentary perspective view of an enlarged section of the sheet shown in FIGS. 1 and 2 having a wire form support element installed therein to maintain a concave shape established in the corrugated plastic sheet.

Referring to the drawings, and particularly FIGS. 1–3, a concave reflector 10 is constructed from a sheet 12 of corrugated plastic. Such corrugated plastic sheet material is commercially available and is constructed from a high density polyethylene or polypropylene plastic. A corrugated layer 14 is overlain by a flat cover layer 16, preferably on one side only, and heat fused along the lines of contact with the respective sides of the individual corrugations. A multitude of lengthwise extending slight depressions results from this construction.

Suitable corrugated plastic sheet may be obtained for example from United States Corrulite Corp. under the Trademark "Corrulite."

The corrugated plastic sheet 12 is formed into a composite material by treating the outer surface of one side to be brightly reflective. This is accomplished by application of a thin metallized, mirrored film 18 on the surface of the cover layer 16 of the corrugated plastic sheet 12.

The thin mirrored film 18 must be sufficiently thin and compliant so as to conform to the lengthwise slight valley depressions 20 occurring along the line of fusing between the corrugations 14 and cover layer 16.

The film 18 may be constructed using a polyester plastic film approximately 0.001 inch thick having a silver metallization applied to one side. This metallization can be accomplished by magnetron sputtered vacuum deposition process, in which atoms of pure silver are bombarded onto the film surface. Such metallized film is commercially produced by Deposition Technologies, Inc.

An adhesive system is applied to the metallized side of the polyester film which can bond to the plastic cover layer 16. In order to properly bond to the polyethylene or polypropylene plastic, a corona or flame treatment of the surface may be carried out, thereafter using a water or solvent based, thermosetting, cross linkable dry bonding adhesive with an added moisture curing component to bond the unmetallized side of the film 18 to the treated surface of the outer layer 16.

The film 18 when applied conforms to the lengthwise valley depressions 20 and forms a great number of closely spaced lengthwise striations 22 creating a reflector surface having a multitude of facets which very effectively disperses the reflected light.

As the sheet 12 is formed into a concave curved shape, slight bending along the lengthwise depressions 20 tends to enhance the formation of the facets.

The single faced corrugated sheet 12 is readily formable into a concave curved shape, the lengthwise corrugations tending to establish a uniform concave shape.

A single shape retaining element, i.e., a length of heavy gauge wire 24 is provided extending transversely across the center of the sheet intermediate the ends thereof. The shape retaining wire 24 is passed through the sides of the corrugations forming the corrugated layer 14, and is readily bent as the concave shape is formed, but retains its bent shape to hold the sheet in its concave shape.

By using a single wire length at the center rather than multiple wire elements, shaping of the sheet into a curved shape is made simple and the uniformity of the concave shape is easily achieved along the length of the reflector 10.

Figure 4:
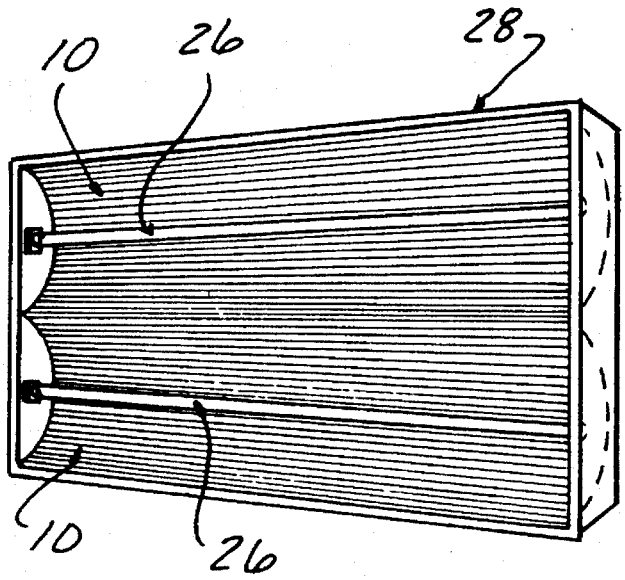
FIG. 4 is a perspective view of a light fixture showing a pair of the reflectors of FIG. 1 installed therein.

The resultant reflector 10 as seen in FIGS. 1 and 4 is a very lightweight structure and can be simply inserted above the fluorescent tube 26 in a fixture housing 28 either singly or in pairs. The lightweight sheet 10 may not require a separate fastening means in order to be supported, although adhesive patches can be employed.

It is noted that the plastic of the corrugated plastic sheet must be formulated to resist the relatively warm temperatures which exist in a fluorescent tube fixture. Such suitably formulated corrugated plastic sheet is commercially available.

The great number of facets forming the reflective surface created by the striations 22 provide a very effective dispersal of the reflected light due to the extremely segmented nature of the curving reflector surface provided.

Figure 5:
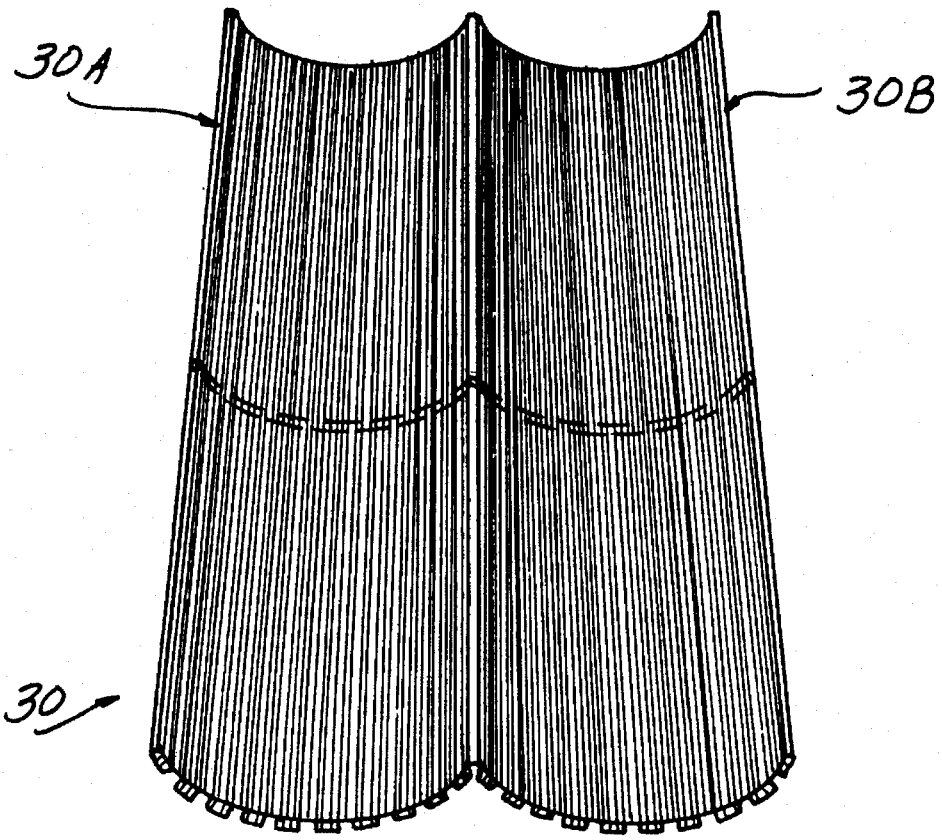
FIG. 5 is a perspective view of a double reflector formed from a double faced corrugated sheet piece, the back of which is slit at spaced intervals.
Figure 6:
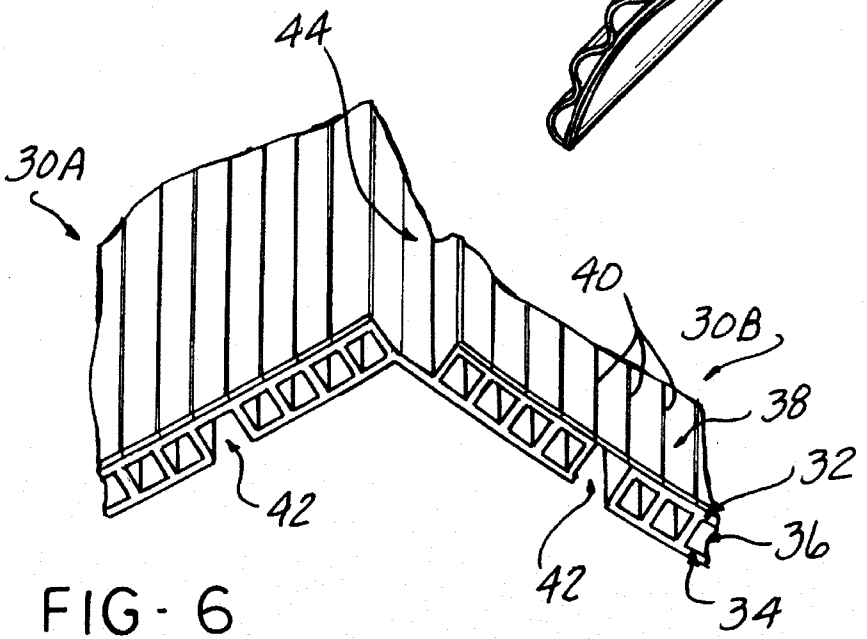
FIG. 6 is an enlarged view of the juncture of the double reflector shown in FIG. 5 showing the reverse bend.

FIGS. 5 and 6 show the use of a double faced corrugated plastic sheet used to form a double reflector 30, comprised of side by side concave reflectors 30A, 30B attached along one side.

A pair of cover layers 32, 34 are heat fused to a respective side of the corrugation layer 36, with a metallized film layer 38 bonded to the inside layer 32.

The striations 40 described above are also formed by this construction.

Lengthwise slits 47 are cut through the outside and corrugation layers 34, 36 at spaced locations to aid in establishing the concave curvature of the inside surface.

However, along the joined sides of the reflectors 30A, 30B, a single slit 44 is formed into the outside layer 38 to allow a sharp transition between the concave curvatures of the adjacent reflectors 30A, 30B so that the concavity thereof is unaffected by the bending required.

The single faced corrugated plastic is preferred as the need for slitting is avoided and formability is enhanced.

Figure 7:
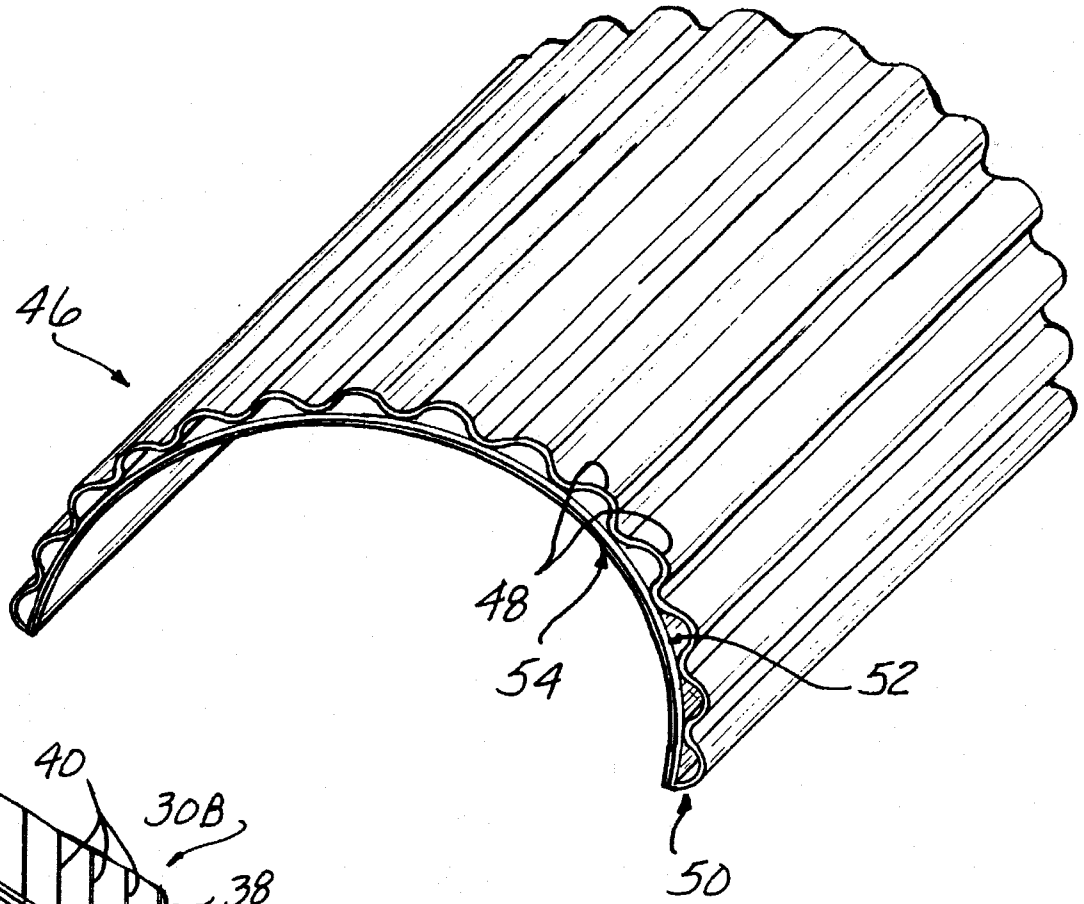
FIG. 7 is a fragmentary perspective view of an alternate form of corrugated sheet used to form a reflector.

FIG. 7 shows another form of single faced corrugated plastic used to create another curved reflector 46, in which curved corrugations 48 make up the corrugation layer 50, with a single cover layer 52 heat fused to the apexes of the corrugations on one side. The metallized film 54 is adhered to the inside surface as in the above embodiments.

Since the plastic sheet material is easily cut with ordinary scissors and is lightweight, custom fitting in the field is facilitated. The wire form element 24 can be easily shaped with manually exerted pressure such as to also facilitate the field fabrication of such fluorescent light fixture reflectors.

The reflector 10 may also be preshaped and installed during manufacture on the light fixture rather than in the field retrofit.

FIGS. 8–11 show arrangements for installing the reflector 26 by being supported on a light tube.

Figure 8:
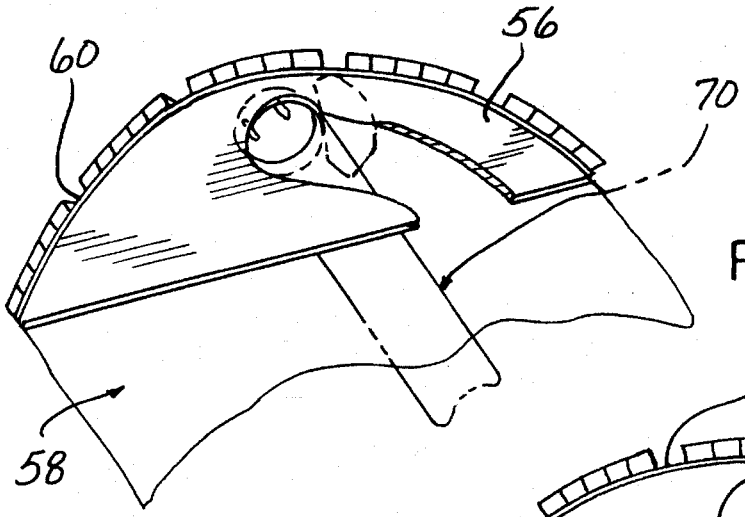
FIG. 8 is a fragmentary end view of a reflector according to the invention provided with slotted end pieces adapted to be snapped over the light tube in order to hold the reflector above the tube.
Figure 9:
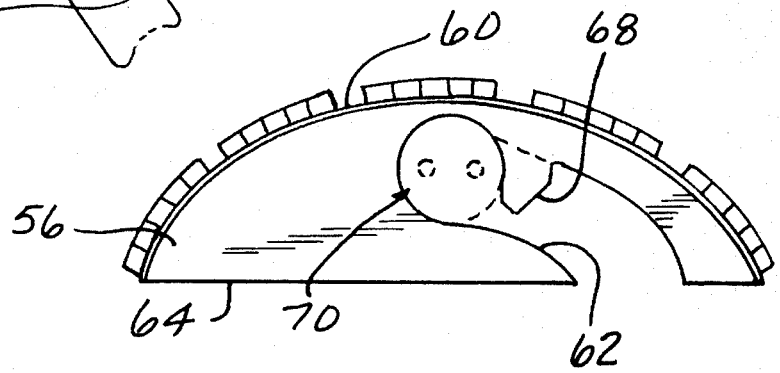
FIG. 9 is an enlarged end view of the end piece shown in FIG. 9.

FIGS. 8 and 9 show an end piece 56 affixed to each end of a concavely curved reflector sheet 58 constructed of plastic corrugated sheet material in accordance with the invention.

Each end piece 56 has a curved contour 60 matched to the desired curvature of reflector sheet 58. An angled slot 62 of a width equal to the diameter of the tube 70 extends up from the lower straight edge 64 and terminates in a circular tube receiving recess 66.

A tab 68 defines in part the recess 66, normally protruding into the slot 62, but is bendable to allow the tube 70 to pass by and into the recess 66.

The end pieces 56 may also be constructed of corrugated plastic sheet material adhesively affixed to the reflector sheet 58, but may be constructed of other materials.

Thus, the reflector sheet 58 is held spaced above the tube 70 by engagement of the tube 70 in recesses 66 of the two end pieces 56.

Figure 10:
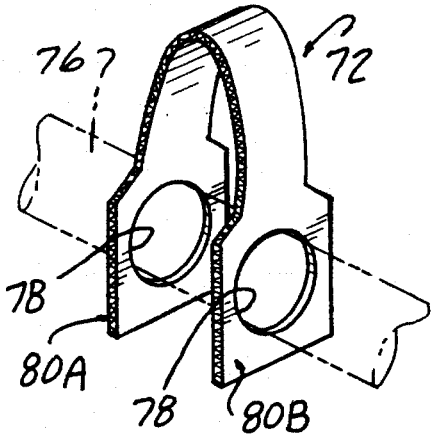
FIG. 10 is a perspective view of a folded holder alternatively used to support the reflector with the light tube.
Figure 11:
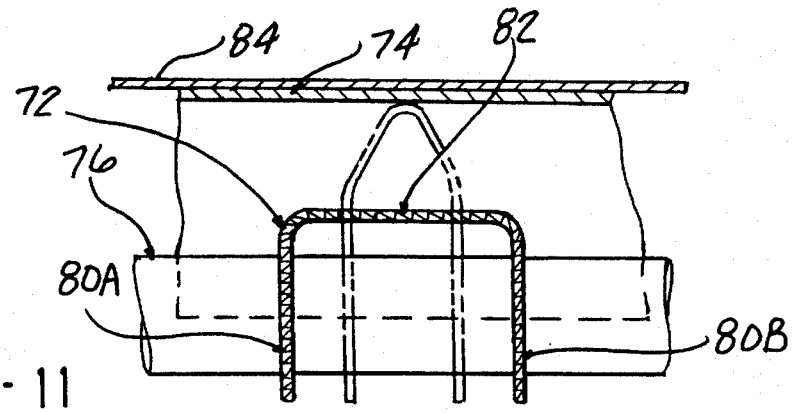
FIG. 11 is a side sectional view of a reflector being supported on a tube by the holder shown in FIG. 3.

FIGS. 10 and 11 show another mounting arrangement in which a pair of foldable support pieces 72 are used to support a reflector sheet 74 and a light tube 76.

The foldable support pieces 72 comprise a strip of bendable material, such as corrugated plastic sheeting, which has a pair of round holes 78, each sized to tightly receive the light tube 76. The support pieces 72 in use are folded at their midpoint to create two flaps 80A, 80B to align the two holes 78 and allow the insertion of tube 76. In an initial position, the flaps 80A, 80B are pulled apart to straighten the intermediate section 82. Upon bringing the flaps 80A, 80B together, the intermediate section 82 arches upwardly to push the reflector sheet 74 up against the fixture top wall 84, as shown in phantom. The relatively light weight of the reflectors constructed of corrugated plastic sheet allows the use of such simple, easy-to-use holder arrangements.

We claim:

1. A method of fabricating a concavely curved trough shaped reflector comprising:

bonding one side of a film having another side thereof metallized to be brightly reflective to one side of a corrugated plastic sheet having a length, width, and thickness, said corrugated plastic sheet also having a uniform series of lengthwise extending closely spaced, slight depressions formed in an outer surface of a cover layer forming one side of said sheet, said film being sufficiently thin and compliant to conform to said slight depressions on said cover layer so that a multitude of lengthwise striations are formed in the metallized surface on an outer side of said film when said one side of said film is bonded to said cover layer outer surface to be in conformity with said depressions; and, forming said sheet with said film bonded thereto into a concavely curved shape with said metallized another surface of said film exposed on said concavely curved side thereof, so that a concavely curved reflector with a multitude of reflector facets is formed by said striations in said film another side.

2. The method of claim 1 further including installing said reflector in a fluorescent light fixture above a fluorescent light tube.

3. The method of claim 2 wherein said concavely curved reflector has opposite ends, and wherein slotted end pieces are affixed to either opposite end of said curved reflector formed by said film and corrugated plastic sheet, and said end pieces are advanced onto a fluorescent light tube inserted into each slot to support said reflector sheet on said tube.

4. The method of claim 3 wherein a bendable tab is formed on each end piece projecting into said slot thereof, and each tab is bent over to allow insertion of said light tube and bent back to hold said tube therein.

5. The method of claim 2 wherein a pair of holder pieces are installed on a fluorescent light tube, each holder piece comprising a strip of bendable material having a pair of holes formed therein, each hole at a respective end of said strip of material, said holes sized to tightly fit on said light tube, said method including the step of folding said strip over to align said holes and inserting said light tube therethrough, and pushing said ends together to arch an intermediate portion up to engage said concavely curved reflector.

6. The method of claim 1 wherein said corrugated plastic sheet is single faced having a cover layer only on said one side and having uncovered corrugations on an opposite other side, and in said forming step, said sheet is shaped so that said cover layer is concavely shaped and said other side of said sheet is convexly shaped.

7. The method of claim 6 wherein in applying a reflective surface treatment, a mirrored film is adhered to said one cover layer of said corrugated plastic sheet.

8. The method of claim 1 wherein said corrugated plastic sheet is double faced with said cover layer forming said one side and another cover layer forming an opposite other side, and wherein said forming step includes slitting one of said cover layers of said corrugated plastic sheet lengthwise to form a series of parallel, easily bent lines extending lengthwise along said corrugated plastic sheet, and in said step of forming said concavely curved shape, said corrugated plastic sheet is curved with said slit cover layer on the outside.

9. The method of claim 8 further including forming a double reflector by slitting said another cover layer and forming two attached sections of corrugated plastic sheet by shaping adjacent sections of said sheet into respective concave shapes, whereby two side by side attached concave reflectors are formed.

10. The method of claim 1 further including attaching a single elongated support element of bendable material extending across the width of said corrugated plastic sheet at a point intermediate the length thereof, said element held in shape when bent into a curved shape so as to hold said corrugated plastic sheet in said concavely curved shape.

11. The method of claim 10 wherein in attaching said supporting element, a wire is passed within the thickness of said corrugated plastic sheet across the width of said sheet.

12. A concavely formed reflector comprising:

a corrugated plastic sheet having a thickness, length, and width, said corrugated plastic sheet comprising a corrugated layer having lengthwise extending corrugations and a cover layer attached to one side of said corrugation layer and forming one side of said corrugated plastic sheet, said corrugated plastic sheet formed into a concave trough shape extending parallel to said lengthwise corrugations of said corrugated plastic sheet to form a concavely curved surface on said one side of said corrugated plastic sheet, said corrugated plastic sheet having a series of closely spaced lengthwise extending depressions formed in an outer surface of said cover layer; and, film bonded on said outer surface side of said cover layer of said corrugated plastic sheet defining said concavely curved surface, said film having an exposed surface metallized so that said concavely defined surface defines a reflector surface, said film being sufficiently thin and compliant to conform to said depressions in said cover layer to form a corresponding series of striations in said reflector surface thereby creating a reflector having a series of closely spaced facets.

13. The reflector of claim 12 wherein said corrugated plastic sheet is single faced having a cover layer on said one side only, another side thereof uncovered and opposite said concavely curved surface.

14. The reflector of claim 12 wherein another side of said corrugated plastic sheet opposite said one side also has a cover layer attached to said corrugated layer and is slit lengthwise at laterally spaced intervals corresponding to the spacing of said corrugations.

15. The reflector of claim 12 further including an elongated form support element of bendable material attached extending across said corrugated plastic sheet, said element bent into a curved shape.

16. The reflector of claim 15 wherein said form support element comprises a length of heavy metal wire.

17. The reflector of claim 16 wherein said length of heavy metal wire extends within the thickness of said corrugated plastic sheet, through and across said corrugations thereof.

18. The reflector of claim 12 wherein said reflector has a pair of opposite ends and further including a pair of end pieces, each end piece fit into and closing off a respective end of said curved reflector sheet, said pair of end pieces each having a slot to be able to receive a fluorescent light tube.

19. The reflector of claim 18 wherein each end piece has a bendable tab extending into said slot to hold said reflector on said light tube after insertion in said slot.

20. A method of fabricating a concavely curved trough shaped reflector comprising:

applying a reflective mirror surface treatment to a cover layer defining one side of a corrugated plastic sheet having corrugations covered by said cover layer on one side, said corrugations creating a number of closely spaced striations visible through said cover layer;

forming a series of lengthwise extending reflector facets by said surface treatment covering said striations in a manner so as to be visible to form said lengthwise reflector facets; and, forming said sheet into a curved shape with said reflective surface treatment on a concavely curved side thereof and with said series of reflectors distributed about said curved shape, whereby said reflectors disperse light reflected from said curved surface while maintaining a high degree of reflectivity.

* * * * *